US007770985B2

(12) United States Patent
Davis et al.

(10) Patent No.: US 7,770,985 B2
(45) Date of Patent: Aug. 10, 2010

(54) KITCHEN APPLIANCE HAVING FLOATING GLASS PANEL

(75) Inventors: Norman B. Davis, Cleveland, TN (US); Lawrence J. Ertz, Amana, IA (US); Jon Freesmeier, Cedar Rapids, IA (US); Steven M. Haring, Ooltewah, TN (US); Chad Jonathan Rotter, Amana, IA (US); Barry E. Tuller, Humboldt, TN (US)

(73) Assignee: Maytag Corporation, Benton Harbor, MI (US)

( * ) Notice: Subject to any disclaimer, the term of this patent is extended or adjusted under 35 U.S.C. 154(b) by 414 days.

(21) Appl. No.: 11/353,945

(22) Filed: Feb. 15, 2006

(65) Prior Publication Data

US 2007/0188059 A1 Aug. 16, 2007

(51) Int. Cl.
*A47B 17/04* (2006.01)

(52) U.S. Cl. ..... 312/204; 312/328

(58) Field of Classification Search ..... 312/326, 312/327, 265.5, 204, 109, 311; 403/381; 49/501; 52/DIG. 8, 843, 845, 782.1, 783.1, 52/742.11

See application file for complete search history.

(56) References Cited

U.S. PATENT DOCUMENTS

| | | | | |
|---|---|---|---|---|
| 2,720,683 | A | 10/1955 | Schwenker et al. | |
| 2,973,235 | A | 2/1961 | Saunders | |
| 3,313,065 | A | 4/1967 | Sandin | |
| 3,525,190 | A | 8/1970 | Saunders et al. | |
| 3,631,630 | A | 1/1972 | Buffington et al. | |
| 3,659,582 | A | 5/1972 | Morgan | |
| 3,662,492 | A | 5/1972 | Bradley | |
| 3,773,399 | A * | 11/1973 | Sulcek | 312/204 |
| 3,828,763 | A | 8/1974 | Wilson | |
| 3,936,107 | A * | 2/1976 | Gourdeau et al. | 312/329 |
| 4,074,677 | A | 2/1978 | Lotz | |
| 4,229,921 | A | 10/1980 | Schell | |
| 4,638,788 | A * | 1/1987 | Lancelot | 126/198 |
| 4,732,431 | A | 3/1988 | Mason | |
| 4,815,798 | A | 3/1989 | Rock et al. | |
| 5,013,106 | A | 5/1991 | Twellmann | |
| 5,076,723 | A | 12/1991 | Berger | |

(Continued)

FOREIGN PATENT DOCUMENTS

| | | |
|---|---|---|
| DE | 3712232 | 10/1988 |

(Continued)

*Primary Examiner*—Janet M Wilkens
*Assistant Examiner*—Matthew W Ing
(74) *Attorney, Agent, or Firm*—Kirk W. Goodwin; John W. Morrison; Diederiks & Whitelaw PLC

(57) ABSTRACT

A kitchen appliance includes a door having an outer panel portion and an inner panel portion, with a plurality of mounting members being spaced about the outer panel portion of the door. A glass panel assembly, including a glass panel and a plurality of mounting elements, is detachably mounted to the door through the interengagement of the plurality of mounting elements with the plurality of mounting members. The mounting elements are adhesively secured to the glass panel. Neither the plurality of mounting members nor the plurality of mounting elements are readily visible normally when viewing the kitchen appliance such that the glass panel appears to float relative to the door.

18 Claims, 9 Drawing Sheets

U.S. PATENT DOCUMENTS

| | | | | | |
|---|---|---|---|---|---|
| 5,313,035 | A | | 5/1994 | Chartrain et al. | |
| 5,317,129 | A | * | 5/1994 | Taplan et al. | 219/452.12 |
| 5,358,326 | A | | 10/1994 | Cherry et al. | |
| 5,375,923 | A | | 12/1994 | Hall et al. | |
| 5,520,453 | A | | 5/1996 | Aoki et al. | |
| 5,584,547 | A | * | 12/1996 | Trulaske, Sr. | 312/223.5 |
| 5,735,261 | A | | 4/1998 | Kieslinger | |
| 5,766,702 | A | | 6/1998 | Lin | |
| 5,806,942 | A | * | 9/1998 | Jenkins et al. | 312/204 |
| 5,810,501 | A | * | 9/1998 | Ross | 403/231 |
| 5,928,540 | A | * | 7/1999 | Antoine et al. | 219/391 |
| 6,138,433 | A | | 10/2000 | Ridge | |
| 6,408,841 | B1 | | 6/2002 | Hirath et al. | |
| 6,519,899 | B1 | * | 2/2003 | Hurzeler | 49/501 |
| 6,557,956 | B2 | * | 5/2003 | Hightower | 312/204 |
| 6,561,180 | B1 | * | 5/2003 | Austin et al. | 126/198 |
| 6,854,458 | B2 | | 2/2005 | Herzer | |
| 2003/0008096 | A1 | | 1/2003 | Benitz | |
| 2004/0183413 | A1 | | 9/2004 | Koo | |
| 2004/0201337 | A1 | * | 10/2004 | Wuestefeld et al. | 312/311 |
| 2004/0214475 | A1 | * | 10/2004 | Costello et al. | 439/700 |

FOREIGN PATENT DOCUMENTS

| | | | |
|---|---|---|---|
| DE | 19750946 | | 10/1998 |
| EP | 811806 | | 12/1997 |
| GB | 2050814 | * | 1/1981 |
| GB | 2188830 | * | 10/1987 |
| GB | 2198621 | | 6/1988 |
| GB | 2186311 | | 8/1997 |
| GB | 2310876 | | 9/1997 |
| JP | 59147936 | | 8/1984 |
| JP | 04-024482 | | 1/1992 |
| JP | 04-052489 | | 2/1992 |
| JP | 4240378 | | 8/1992 |
| JP | 405093582 | | 4/1993 |
| JP | 5126461 | | 5/1993 |
| JP | 5133677 | | 5/1993 |
| JP | 09-096488 | | 4/1997 |
| JP | 9302840 | | 11/1997 |
| WO | WO 95/06790 | | 3/1995 |

* cited by examiner

KITCHEN APPLIANCE HAVING FLOATING GLASS PANEL

BACKGROUND OF THE INVENTION

1. Field of the Invention

The present invention pertains to the art of kitchen appliances and, more particularly, to mounting a decorative glass panel to an appliance door such that the glass panel appears to float relative to the appliance door.

2. Discussion of the Prior Art

Providing a decorative facade to kitchen appliances is well known in the art. The decorative facade allows the appliance to "tie-in" to overall kitchen décor. The decorative facade can take on a variety of forms from something as simple as a coat of paint to made to order wooden panels that match adjacent cabinetry. In many cases the decorative panel takes the form of a replaceable plastic or metal sheet that is mounted to a door of the appliance with peripheral trim components.

In addition to mounting wood, plastic or metal panels to appliance doors, it is now quite common to employ glass panels. Typically, the glass panel is secured to the appliance through trim pieces in a manner similar to that employed with plastic and metal panels. That is, the trim piece includes a first section that is secured to the appliance door with, for example, a mechanical fastener, and a second section that extends over side and front surfaces of the glass panel. While effective at holding the glass panel on the door, the trim piece visibly detracts from an overall aesthetic appearance of the appliance. More specifically, experience has shown that many consumers like a smooth or seamless appearance to the appliance. In order to obtain such an appearance, manufactures have employed various techniques to secure glass panels to the appliance.

For example, as described in U.S. Patent Application Publication No. 2004/0183413, an external decorating member formed from glass is covered on one side with a layer of paint and then installed on a door of the appliance with adhesive. The glass panel is mounted in such a way so that the layer of paint is in continuous, direct contact with a front surface of the door to prevent the layer of paint from being scratched. While this method results in a somewhat seamless appearance, once installed, the glass panel cannot be removed without causing some damage either to the glass panel itself or the door. More importantly, mounting a glass panel in this fashion detracts from the aesthetics provided by glass. That is, the paint and adhesive generally make the glass panel appear identical to a metal panel.

In another example, as described in U.S. Pat. No. 6,854,458, an glass front panel is secured to an inner glass panel with angled retaining elements and a peripheral seal. The angled retaining elements are secured to both the inner glass panel and the glass front panel with adhesive. The peripheral seal is secured to the glass front panel and to a raised pan border portion of the inner glass panel. While this method also results in a somewhat seamless appearance, once installed, the glass front panel cannot be easily removed. If the glass panel is ever cracked or a different finish is desired, removing the panel from the appliance would prove difficult. Moreover, in order the maintain the peripheral seal, the inner glass panel must be specially molded to incorporate the raised pan border portion and, in a manner similar to that described above, the glass panel appears to be a "part" of the appliance as opposed to "floating" in front of the appliance.

Based on the above, there still exists a need in the art for an enhanced decorative glass panel arrangement for a kitchen appliance. More specifically, there exists a need for a decorative glass panel that can be mounted in such a way so as to provide a seamless appearance, yet also be readily detachable from, and appear to float relative to the appliance.

SUMMARY OF THE INVENTION

The present invention is directed to the mounting of a glass panel mounted to a door of a kitchen appliance. The kitchen appliance includes a support body within which is arranged a compartment having a frontal opening. A door, shiftably supported by the support body, selectively covers the frontal opening to provide access to the compartment. The door includes an outer panel portion and an inner panel portion. In accordance with the invention, a plurality of mounting members are spaced about the outer panel portion of the door.

The door also includes a glass panel assembly including a glass panel and a plurality of mounting elements. The glass panel is detachably mounted to the door through the interengagement of the plurality of mounting elements with the plurality of mounting members. Preferably, the mounting elements are adhesively secured to the glass panel and are not visible when viewing the kitchen appliance from the front. Actually, the plurality of mounting members and mounting elements are spaced from edge portions of the door and glass panel respectively so as to not be visible when viewing the kitchen appliance from the front or angular side views. With this construction, the glass panel truly appears to float relative to the door.

Additional objects, features and advantages of the present invention will become more readily apparent from the following detailed description of preferred embodiments when taken in conjunction with the drawings wherein like reference numerals refer to corresponding parts in the several views.

DETAILED DESCRIPTION OF THE PREFERRED EMBODIMENTS

Figure 1:
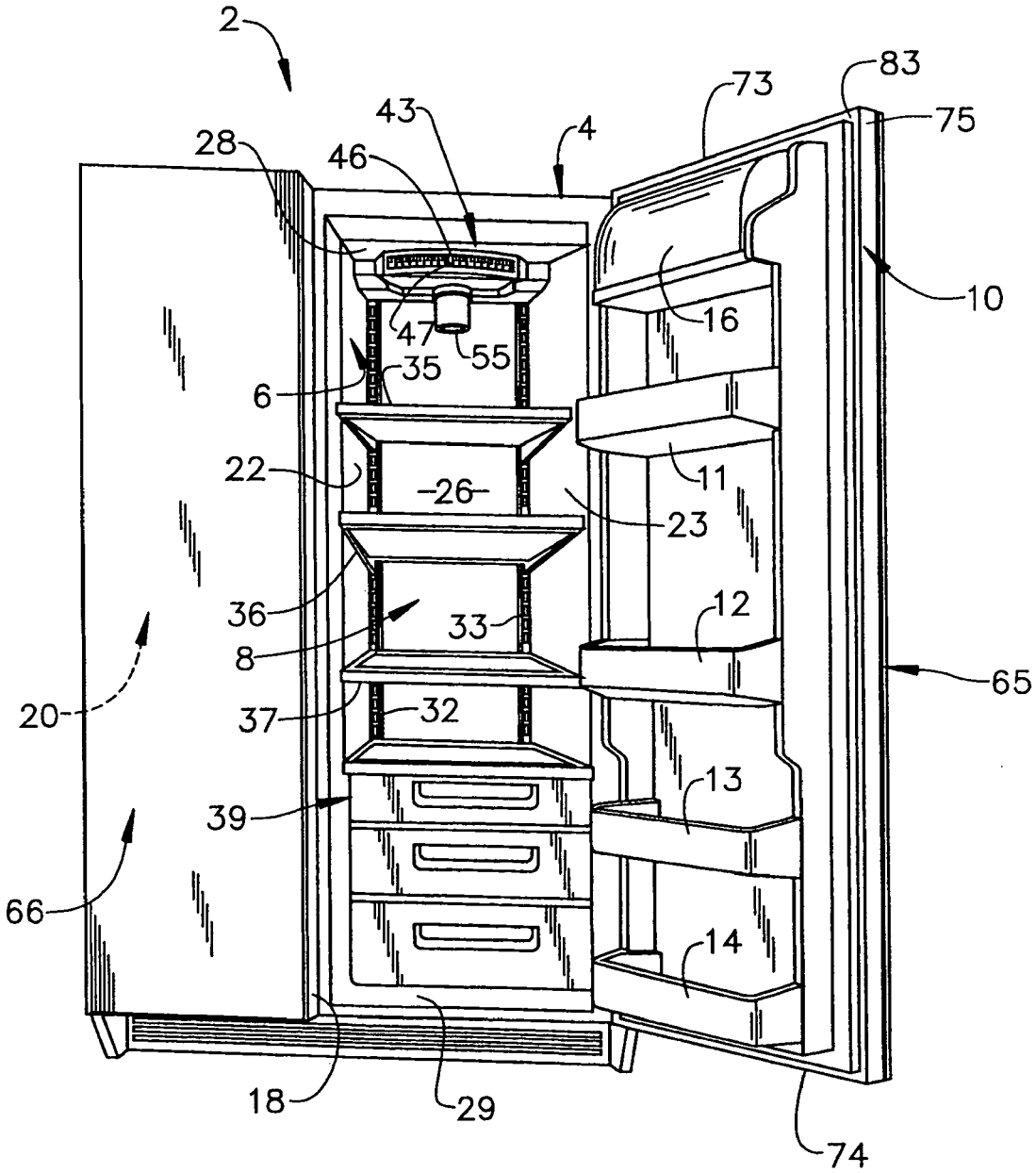
FIG. 1 is an front elevational view of a refrigerator including side-by-side doors incorporating a detachable floating glass panel constructed in accordance with the present invention.

With initial reference to FIG. 1, a kitchen appliance, illustrated in the form of a refrigerator, is generally indicated at 2. Refrigerator 2 includes a support body or cabinet 4 within which is arranged a liner 6 that defines a fresh food compartment 8. Fresh food compartment 8 is provided with a fresh food door 10 having a plurality of vertically adjustable shelves 11-14 and a dairy compartment 16. In the embodiment shown, refrigerator 2 also includes a freezer door 18 that selectively closes a freezer compartment 20. Although the above-described structure constitutes a side-by-side refrigerator 2 used to illustrate the invention, it should be understood that the present invention is also applicable to other refrigerator models, such as top mount and bottom mount refrigerators.

In a manner known in the art, liner 6 includes opposing side walls 22 and 23, a rear wall 26, a top wall 28 and a bottom wall 29. In the embodiment shown, mounted to rear wall 26 are a pair of shelf support rails 32 and 33 that position various vertically adjustable shelves 35-37 in fresh food compartment 8. Arranged below shelves 35-37 is shown a plurality of storage bins, one of which is indicated at 39. In a manner also known in the art, refrigerator 2 includes a temperature control housing 43 mounted to top wall 28 in fresh food compartment 8. Temperature control housing 43 includes at least one control element 45 for setting and maintaining a temperature within fresh food compartment 8, as well as controls 46 and 47 for establishing a desired operating temperature within freezer compartment 20. Temperature control housing 43 also includes a light (not separately labeled) that illuminates fresh food compartment 8 and a filter 55 that filters incoming water for an ice maker (not shown).

In accordance with this embodiment of the present invention, refrigerator 2 includes a first glass panel assembly 65 mounted to fresh food door 10 and a second glass panel assembly 66 mounted to freezer door 18. Preferably, first and second glass panel assemblies 65 and 66 are detachably mounted to doors 10 and 18 in such a manner so as to appear to float relative to refrigerator 2. More specifically, glass panel assemblies 65 and 66 are mounted to and spaced from respective doors 10 and 18 such that no mounting hardware is visible when viewing refrigerator 2 from front or side angled views in a manner that will be detailed more fully below. At this point, it should be understood that each door 10 and 18 and glass panel assembly 65 and 66 are similar in construction such that a detailed description will be made with respect to door 10 and glass panel assembly 65 with an understanding that door 18 and glass panel 66 have corresponding structure.

Figure 2:
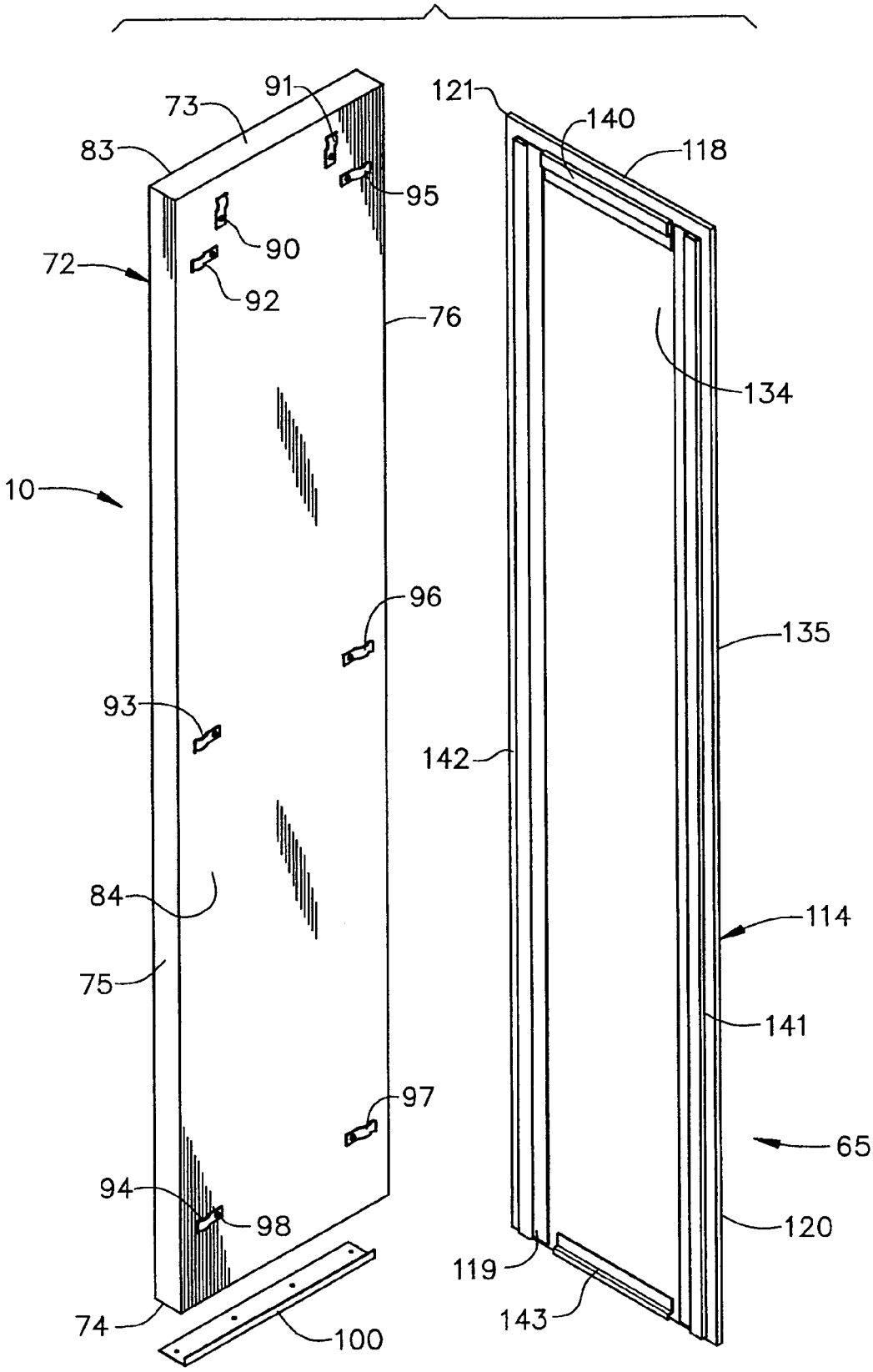
FIG. 2 is an exploded view of one of the side-by-side doors of FIG. 1 illustrating a plurality of mounting members secured to the door and a plurality of mounting elements adhesively mounted to the glass panel.
Figure 3:
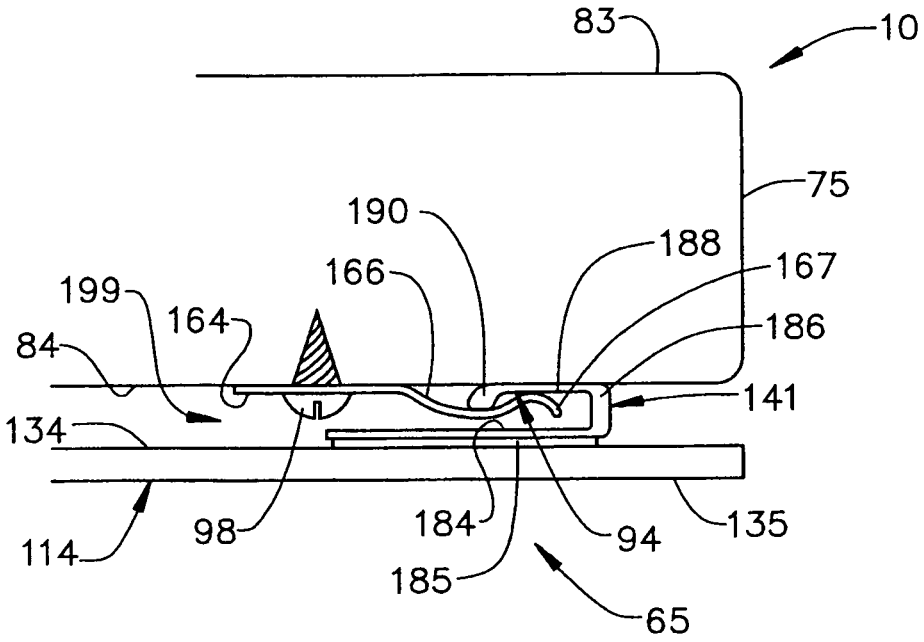
FIG. 3 is a cross-sectional view of a bottom portion of the side-by-side door of FIG. 2 showing one of the plurality of mounting members inter-engaging with one of the plurality of mounting elements to detachable mount the glass panel.
Figure 4:
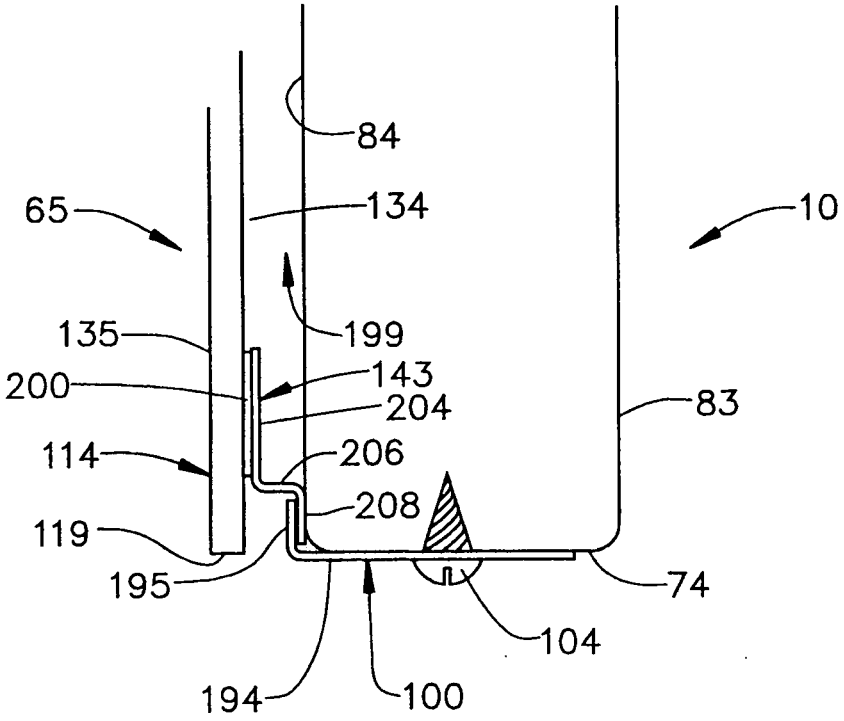
FIG. 4 is a cross-sectional side view of the door of FIG. 2 showing another one of the plurality of mounting members inter-engaging with another one of the plurality of mounting elements.

Referring to FIGS. 2-4, door 10 includes a main body portion 72 having a top edge section 73, a bottom edge section 74 and opposing side edge sections 75 and 76 that define an inner panel portion 83 and an outer panel portion 84. Arranged about outer panel portion 84 are a plurality of mounting members 90-97. Mounting members 90-97 are positioned on outer panel portion 10 spaced inward from edge sections 73-76 and secured with a corresponding plurality of mechanical fasteners, one of which is indicated at 98. In addition, door 10 is provided with a base member 100 that is arranged along bottom edge section 74 and secured through mechanical fasteners one of which is shown at 104 in FIG. 4.

In further accordance with the embodiment shown, glass panel assembly 65 includes a glass panel 114 having a top edge portion 118, a bottom edge portion 119 and opposing side edge portions 120 and 121 that collectively define an inner surface 134 and an outer, decorative surface 135. At this point, it should be understood that glass panel 114 could be formed from a variety of materials, including silicone glass, Pyrex, or even plexi-glass. It should also be understood that outer decorative surface 135 could take on various forms, such as colored or smoked glass, with or without various patterns embossed onto the outer surface 135 of glass panel 114. In any event, arranged on inner surface 134 are a plurality of mounting elements 140-142 designed to cooperate with mounting members 90-97 and a base element 143 that interengages with base member 100 to support glass panel 114 on door 10. Preferably, mounting elements 140-142 are spaced inward from edge portions 118-121 so as to properly align with mounting members 90-97. As will be discussed more fully below, mounting elements 140 and 142 are arranged in such a way as to allow glass panel 114 to slide vertically onto door 10.

At this point, it should be understood that each mounting member 90-97 is preferably identically constructed such that a detailed description will be made with respect to mounting member 94 illustrated in FIG. 3 with an understanding that the remaining mounting members 90-93 and 95-97 are similarly constructed. As shown, mounting member 94 includes a base section 164 which is in contact with outer panel portion 84 and extends to a first curved or out-turned section 166 prior to terminating in a second, out-turned section 167. Base section 164 is secured to outer panel portion 84 by fastener 98 with out-turned section 166 and out-turned section 167 being cantilevered such that mounting member 94 actually defines a spring clip that interengages with mounting element 141 in a manner that will be described more fully below.

It should also be understood that each mounting element 140-142 is similarly constructed such that a detailed description will be made with respect to mounting element 141 with an understanding that mounting elements 140 and 142 include similar structure. As also shown in FIG. 3, mounting element 141 includes a base section 184 that is mounted or secured to inner surface 134 of glass panel 114. Preferably, base section 184 is secured to glass panel 114 with a double-sided adhesive strip 185 of sufficient strength to fixedly and permanently retain mounting element 141. In any case, base section 184 extends to a first or out-turned section 186 that leads to an in-turned section 188 prior to terminating at an angled section 190. This construction ensures that, when interengaged with mounting element 141, mounting member 94 clips onto out-turned section 167 when glass panel 114 is shifted into position.

Once each mounting element 140-142 is properly interengaged with corresponding mounting members 90-97, base element 143 interengages with base member 100. More specifically, as best shown in FIG. 4, base member 100 includes a first section 194 that leads to an up-turned section 195 that, when base member 100 is secured to bottom edge section 74 of door 10 through mechanical fasteners 104, is spaced from outer panel portion 84 so as to define a gap 199. In any event, base element 143 is shown to include a first or flat portion 204 that, in a manner similar to that described above with respect to base section 184, is preferably secured to inner surface 134 of glass panel 114 with an adhesive strip 200. Flat portion 204 extends to an in-turned section 206 that terminates in a down-turned portion 208. Down-turned portion 208 slides between up-turned section 195 and outer panel portion 84 to support glass panel 114 in a manner that will be described more fully below.

When installing glass panel 114 onto door 10, mounting members 90 and 91 transition along outer panel portion 84 until base element 143 abuts base member 100. During the transition, mounting elements 141 and 142 pass through, or interengage with, mounting members 92-97. As best shown in FIGS. 3 and 4, once installed, glass panel 114 is actually spaced from outer panel portion 84 so as to appear to float relative to door 10. That is, while still completely covering door 10, glass panel 114 is maintained a slight distance from outer panel portion 84, with mounting members 90-97, mounting elements 140-142, base member 100 and base element 143 not being visible from front or angled side views of refrigerator 2, so as to provide the illusion that glass panel 114 is suspended in mid-air.

Figure 5:
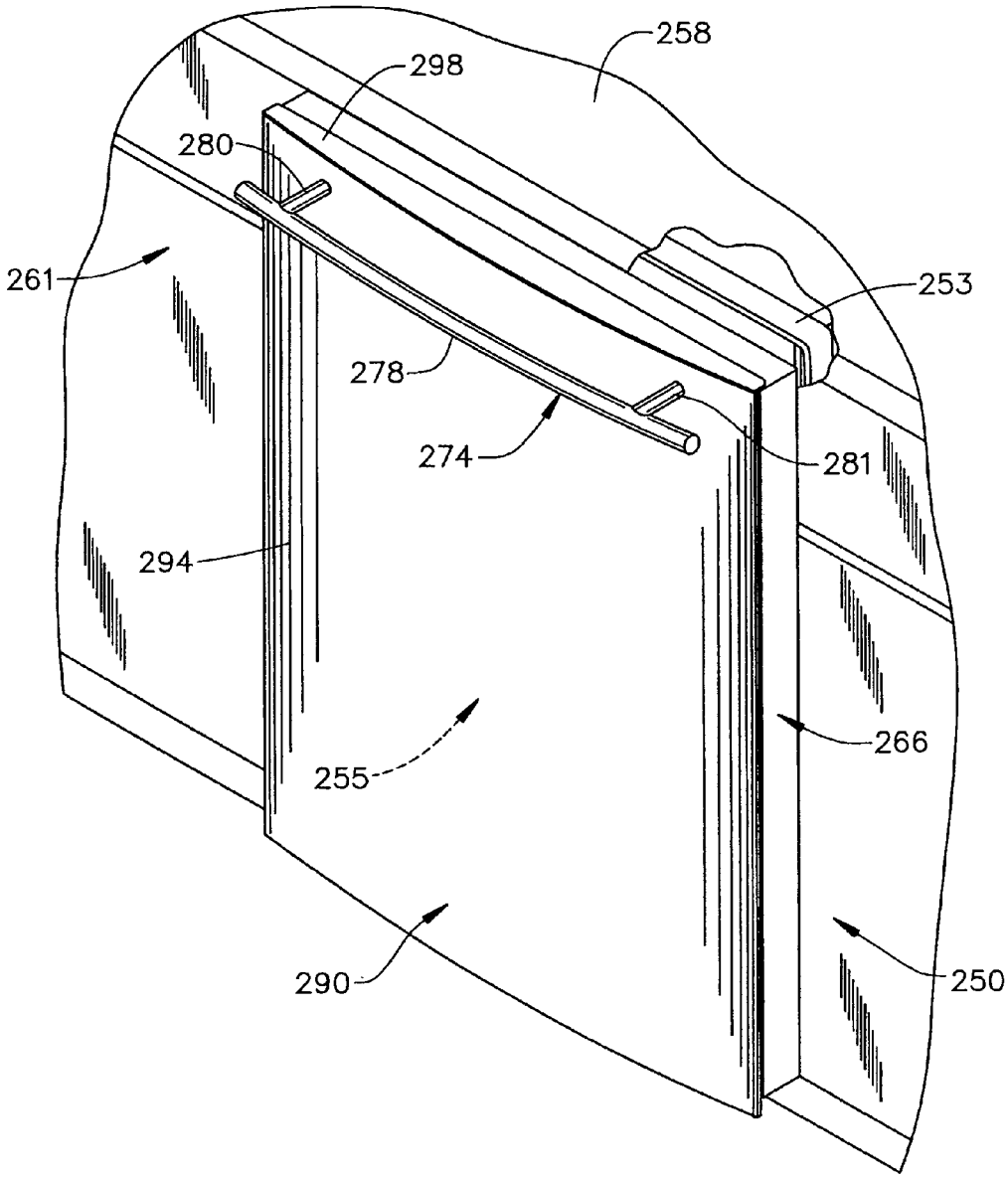
FIG. 5 is a upper right perspective view of a dishwasher having a door incorporating a detachable floating glass panel constructed in accordance with a second embodiment of the present invention.
Figure 6:
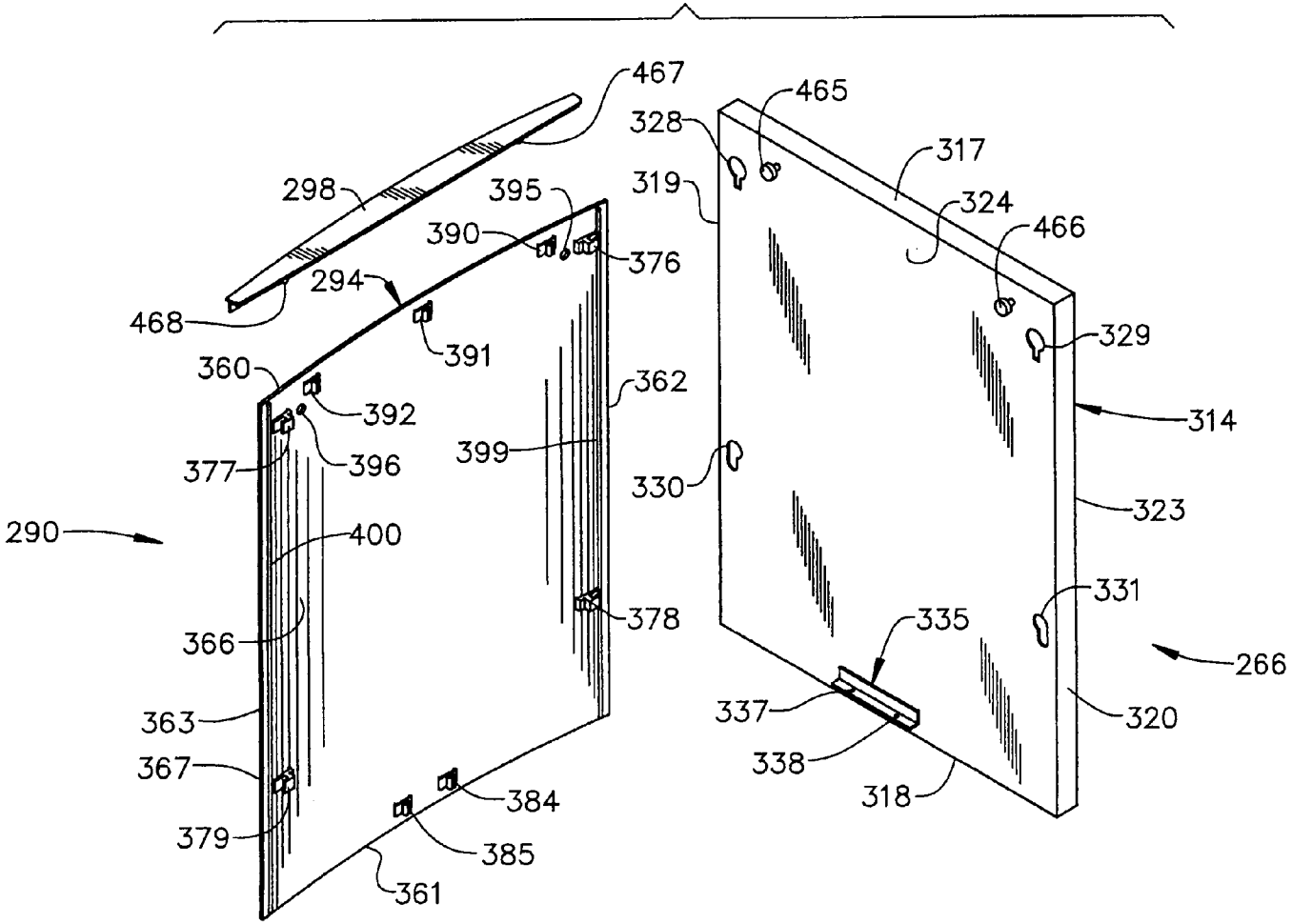
FIG. 6 is an exploded view of the door of FIG. 5 illustrating the plurality of mounting members and the plurality of mounting elements, as well as attachment members constructed in accordance the second embodiment of the invention.
Figure 7:
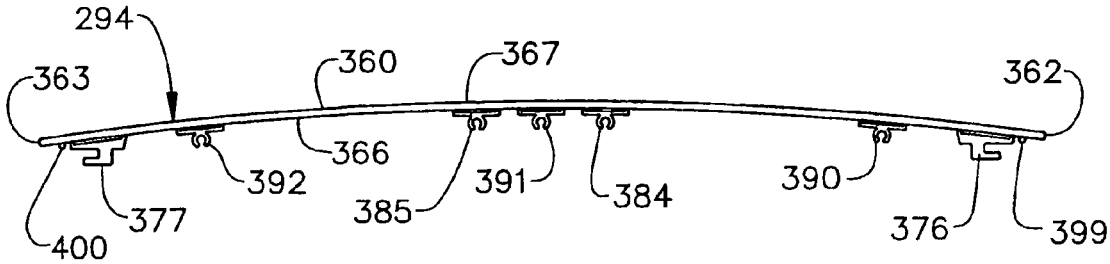
FIG. 7 is a top elevational view of the glass panel of FIG. 6.

Reference will now be made to FIGS. 5-7 in describing a kitchen appliance 250 constructed in accordance with a second embodiment of the present invention. As shown, kitchen appliance 250 takes the form of a dishwasher having a support body or frame member 253 that supports a dishwashing compartment 255. As shown, dishwasher 250 is arranged below a kitchen countertop 258 adjacent cabinetry 261. At this point, it should be understood that, while dishwasher 250 is shown as a conventional-type dishwasher, the present invention can be incorporated into other model types, such as dishwashers having various slide-out washing compartments.

Dishwasher 250 includes a door 266 that pivots about a generally horizontal axis to selectively reveal a frontal opening (not separately labeled) to enable the loading and unloading of dishes into dishwashing compartment 255. Towards that end, door 266 is provided with a handle 274 having a crosspiece 278 as well as first and second support members 280 and 281. In the preferred embodiment, first and second support members 280 and 281 are mounted to a glass panel assembly 290 in a manner that will be described more fully below. More specifically, glass panel assembly 290 includes a glass panel 294, as well as an upper trim piece 298 that provides a finished appearance to door 266. As best shown in FIG. 7, glass panel 294 is actually bowed or curved so as to provide a distinct appearance to door 266. In other words, when viewed from above, glass panel 294 actually has a slight curvature.

As best shown in FIG. 6, door 266 includes a main body portion 314 having a top edge section 317, bottom edge section 318 and opposing side edge sections 319 and 320 that collectively define an inner panel portion 323 and an outer panel portion 324. In accordance with this second embodiment, door 266 includes a plurality of mounting members 328-331 formed in main body portion 314. As shown, mounting members 328-331 are constituted by keyhole-shaped openings formed in main body portion 314. In addition to mounting members 328-331, door 266 includes a generally L-shaped base member 335 mounted to outer panel portion 324 adjacent bottom edge section 318. Base member 335 is provided with a pair of openings 337 and 338 which, as will be discussed more fully below, are adapted to receive mechanical fasteners (not shown) for securing glass panel 294 to door 266.

Glass panel 294 includes a top edge portion 360, a bottom edge portion 361 and opposing side edge portions 362 and 363 that define an inner, decorative surface 366 and an outer surface 367. In a manner corresponding to that described above, inner decorative surface 366 could simply be colored or smoked glass with or without various decorations. In any case, glass panel 294 includes a plurality of mounting elements 376-379 adhesively secured to inner surface 366 and spaced inward along opposing side edge portions 362 and 363. Glass panel portion also includes a pair of base elements 384 and 385 that, as will be detailed more fully below, cooperate with base member 335 to detachably retain glass panel 294 on door 266. Furthermore, in order to secure upper trim piece 298 to door 266 and glass panel 294, a plurality of crown elements 390-392 are adhesively secured to inner surface 366 spaced adjacent top edge portion 360. Also arranged adjacent top edge portion 360 are a pair of openings or holes 395 and 396 for mounting handle 274. Finally, in order to reduce any potential rattling sound when dishwasher 250 is operated and to provide a more seamless appearance, optional silicone beads or seals 399 and 400 are shown extending vertically along opposing side edge portions 362 and 363 on inner surface 366.

Figure 8:
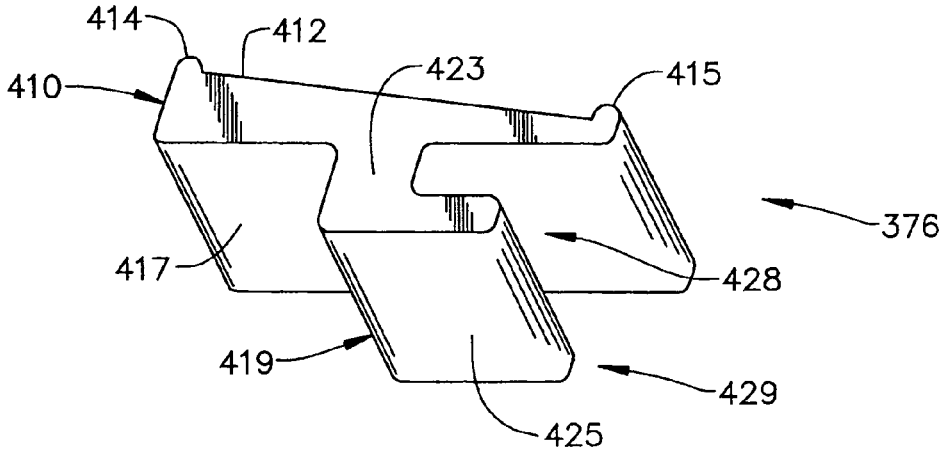
FIG. 8 is a perspective view of one of the attachment members from FIG. 6.

At this point, reference will be made to FIG. 8 in describing a preferred construction for the plurality of mounting elements 376-379 employed in the second embodiment of the present invention. However, as each mounting element 376-379 is identical, a detailed description will be made with respect to mounting element 376 with an understanding that the remaining mounting elements 377-379 are similarly formed. Mounting element 376 includes a main body 410 having a base section 412 provided with a pair of terminal ribs 414 and 415 which provide spacers used in bonding mounting element 376 to inner surface 366 of glass panel 294. Opposite base section 412, main body 410 includes an outer section 417 from which extends a tab member 419. As shown, tab member 419 includes a first portion 423 which extends generally perpendicularly outward from outer section 417 and leads to a second portion 425 which projects substantially perpendicularly from first portion 423 creating a gap 428 between second portion 425 and outer section 417 thereby establishing an L-shaped hook 429. In a manner that will be discussed more fully below, L-shaped hook 429 cooperates or interengages with mounting members 328-331 to secure glass panel 294 to door 266.

Figure 9:
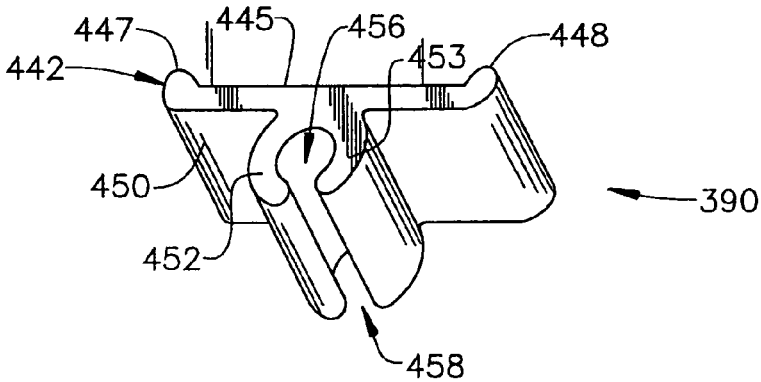
FIG. 9 is a perspective view of one of the plurality of mounting elements from FIG. 6.

As described above, in addition to mounting elements 376-379, glass panel 294 includes a pair of base elements 384 and 385, as well as a plurality of crown elements 390-392. As base elements 384 and 385 and crown elements 390-392 are preferably identical, reference will be made to FIG. 9 in describing crown element 390 with an understanding that the remaining crown elements 391 and 392, as well as base elements 384 and 385 are similarly formed. Crown element 390 includes a main body 442 having a base portion 445 which, in manner similar to that described above, includes a pair of terminal ribs 447 and 448. Opposite base portion 445 is an upper section 450 that is provided with first and second curved elements 452 and 453 that define a central bore 456. Actually, first and second curved elements 452 and 453 project from upper section 450 towards each other to also define a gap 458 leading into central base 456. Gap 458 allows first and second curved elements 452 and 453 to deflect for receipt of a mechanical fastener, such as a self-tapping screw (not shown), into central bore 456.

With this particular construction, once mounting elements 376-379, base elements 384-385 and crown elements 390-392 are secured to glass panel 294, handle 274 is mounted. At this point, upper trim piece 298 is put in position and secured to crown elements 390-392 with mechanical fasteners (not shown). That is, a mechanical fastener (not shown) extends through crown elements 390-392 and taps into trim piece 298. Trim piece 298 is further secured through the interengagement of two laterally spaced round head mechanical fasteners 465 and 466 with corresponding ribs 467, 468 formed on an underside (not separately labeled) of trim piece 298. After upper trim piece 298 is secured, glass panel 294 is placed adjacent door 266 with mounting elements 376-379 aligning with corresponding mounting members 328-331. Once properly aligned, second portions 425 of mounting elements 376-379 are inserted into mounting elements 328-331. Glass panel 294 is then shifted vertically downward, trapping tab members 419 in the keyhole-shaped openings of mounting members 328-331. Glass panel 294 is further secured with mechanical fasteners (not shown) that extend through openings 337 and 338 of base member 335, tapping into base elements 384 and 385.

Figure 10:
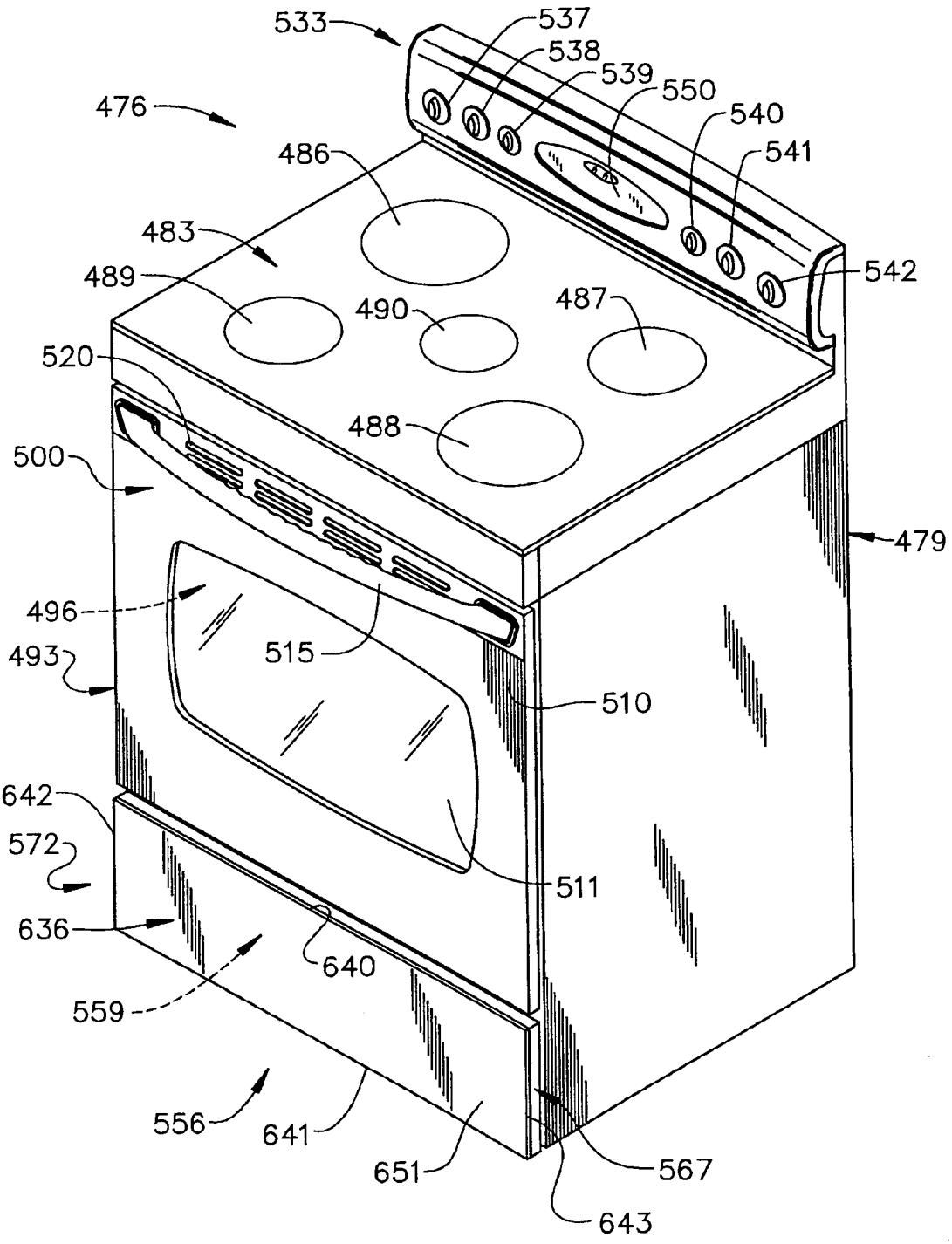
FIG. 10 is an upper right perspective view of a free-standing oven having a storage drawer incorporating a detachable floating glass panel constructed in accordance with a third embodiment of the present invention.

Reference will now be made to FIG. 10 in describing a kitchen appliance 476 constructed in accordance with a third embodiment of the present invention. In the embodiment shown, kitchen appliance 476 constitutes an oven range having a support body or cabinet 479. While shown as a free-standing oven range, kitchen appliance 476 could take various forms, such as a slide-in range or wall oven. In any case, kitchen appliance 476 includes an upper cooking surface or cooktop 483 provided with a plurality of cooking zones 486-490 below which is arranged an oven 493. In a manner known in the art, oven 493 is provided with an oven cavity 496 having a frontal opening (not labeled) which is selectively accessed through a door 500.

In a manner also known in the art, door 500 is shown to include a smooth glass surface 510 having a central transparent zone 511 that allows a consumer to view the contents of oven cavity 496 when door 500 is closed. Door 500 is also provided with a handle 515, as well as a plurality of vents 520 arranged behind handle 515. Arranged above cooktop 483 is a control panel 533 having a plurality of control elements 537-542 that are employed to selectively control cooking zones 486-490, as well as oven 493. Centrally located on control panel 533 is a display 550 that provides information to the consumer, such as cook time remaining, cooking operation selected, etc. Since the control and operation of kitchen appliance 476 in known in the art and does not form part of the present invention, it will not be discussed further herein.

Arranged below oven 493 is a storage zone 556 having a storage compartment 559. Storage compartment 559 is employed to hold, for example, baking trays, broiling pans and the like. In any event, storage compartment 559 is provided with a door 567 having a decorative glass panel assembly 572 attached thereto in accordance with the present invention. In accordance with the embodiment shown, door 567 and storage compartment 559 are slidable in unison between extended and retracted positions.

Figure 11:
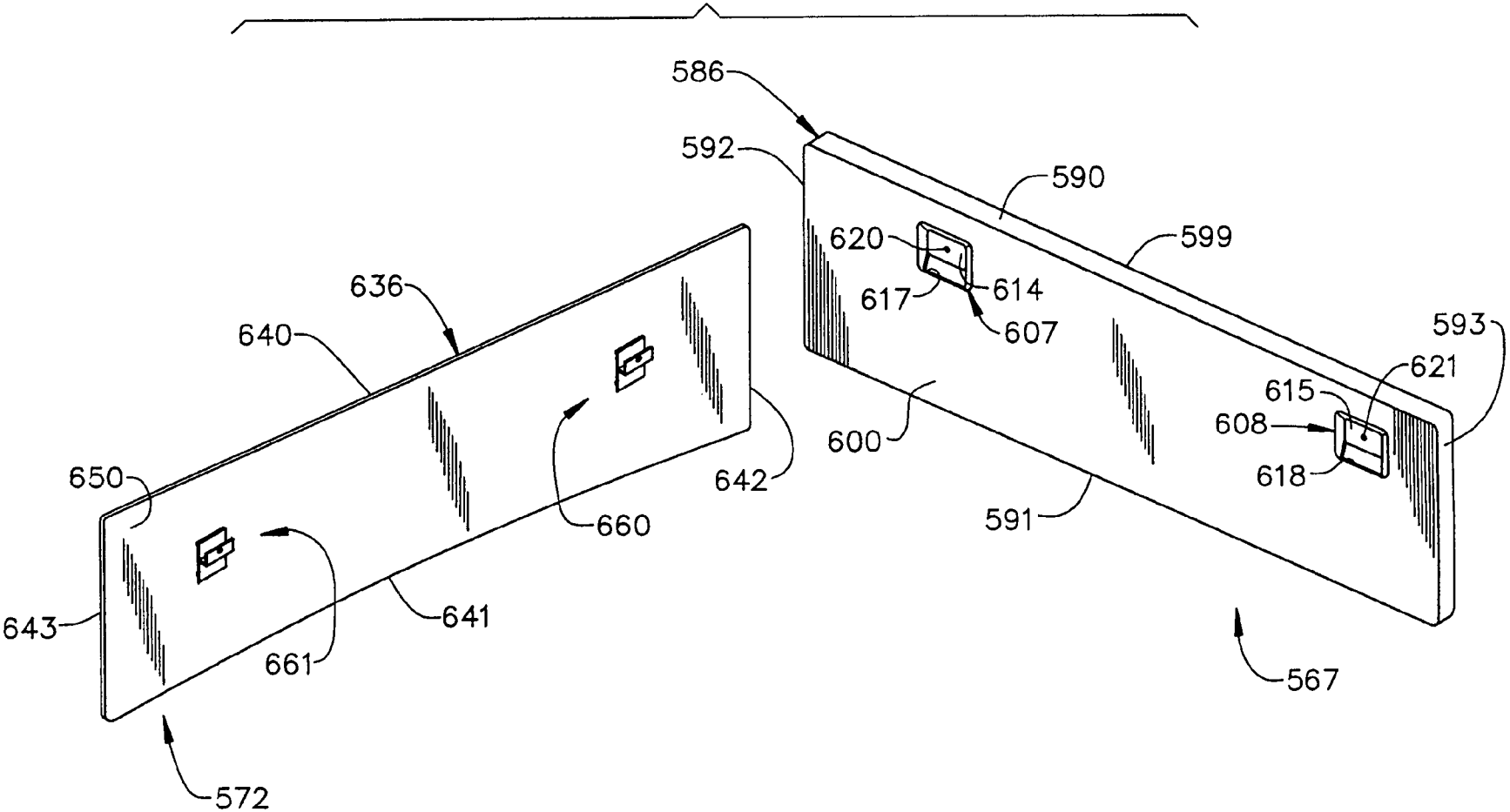
FIG. 11 is an exploded view of a front portion of the storage drawer and glass panel of FIG. 10, illustrating the plurality of mounting members and the plurality of mounting elements constructed in accordance with the third embodiment of the invention.

As best shown in FIG. 11, door 567 includes a main body portion 586 having a top edge section 590, bottom edge section 591 and opposing side edge sections 592 and 593 that collectively define an inner panel portion 599 and an outer panel portion 600. Door 567 includes a pair of mounting members 607 and 608 formed in outer panel portion 600. More specifically, each mounting member 607, 608 constitutes a depressed region 614, 615 that establishes a respective opening 617, 618. Each depressed region 614, 615 also includes a corresponding central opening 620, 621 which, as will be discussed more fully below, receives a mechanical fastener 630 to secure glass panel assembly 572 to door 567.

In accordance with this third embodiment of the present invention, glass panel assembly 572 includes a glass panel 636 having a top edge portion 640, a bottom edge portion 641 and opposing side edge portions 642 and 643 that collectively define an inner surface 650 and an outer surface 651. Arranged on inner surface 650 are a pair of mounting elements 660 and 661 which, as will be described more fully below, interengage with mounting members 607 and 608 to secure glass panel 636 to door 567.

Figure 12:
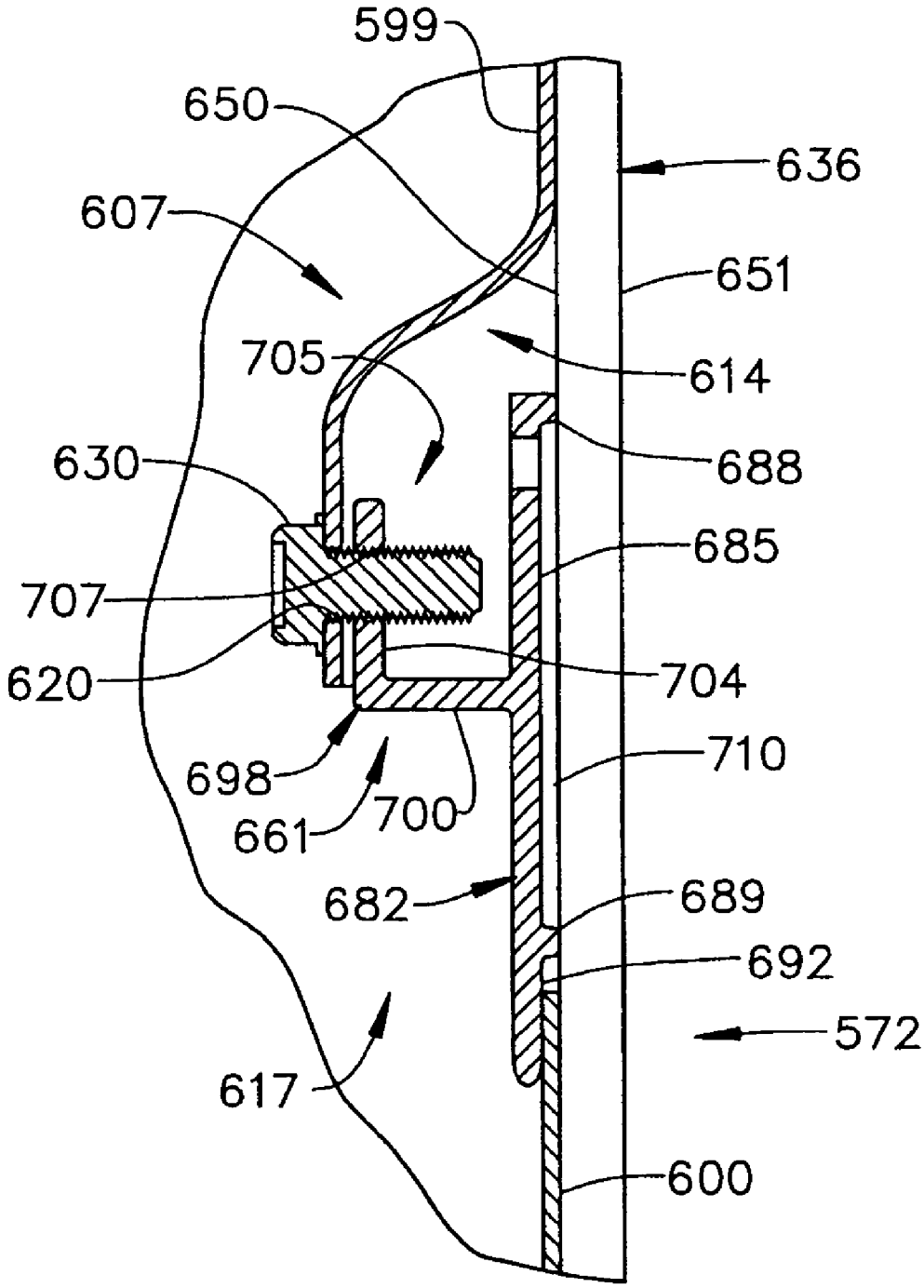
FIG. 12 is a cross-sectional view illustrating the interengagement of one of the plurality of mounting members and one of the plurality of mounting elements in accordance with the third embodiment of the present invention.

Reference will now be made to FIG. 12 in describing mounting elements 660 and 661. As each mounting element 660, 661 is similarly constructed, a detailed description will be made to mounting element 661 with an understanding that mounting element 660 is identical. As shown, mounting element 661 includes a main body 682 having a base section 685 which, in a manner corresponding to that described above with respect to the first and second embodiments, includes a pair of terminal spacer ribs 688 and 689. Base section 685 also includes an extended, cantilevered section 692 that projects beyond rib 689. Mounting element 661 also includes a tab member 698. Tab member 698 includes a first section 700 that extends substantially perpendicularly from base section 685 to a second section 704 that extends substantially perpendicularly outward from first section 700 to establish an L-shaped hook 705. Second section 704 is provided with a threaded opening 707 which, as will be discussed more fully below, receives a mechanical fastener 630.

With this particular arrangement, mounting elements 660 and 661 are initially secured to inner surface 650 of glass panel 636 with respective adhesive strips 710. Once in place, glass panel 636 is positioned against outer panel portion 600 of door 567 with mounting elements 660 and 661 aligning with mounting members 607 and 608 respectively. At this point, glass panel 636 is shifted downward such that cantilevered portions 692 of mounting elements 660 and 661 engage with outer panel portion 600 of door 567 through openings 617 and 618 as illustrated in FIG. 12. Once in place, respective mechanical fasteners 630 are inserted through openings 620 and 621 and engage with threaded openings 707 formed in second section 704 of mounting elements 660 and 661, securing glass panel 636 to door 567.

At this point, it should be understood that the present invention provides for a simple mounting arrangement for securing glass panels to the outer surface of doors of kitchen appliances such that the glass panels appear to float relative to the doors. That is, the glass panel does not appear to be directly affixed to the appliance door but rather an illusion is created wherein the glass panel appears to be advantageously floating in front of the appliance to provide a more aesthetic appearance. In addition, the present invention enables the glass panels to be detachably mounted to the doors such that, in the event the consumer wishes to, for whatever reason, clean or change the appearance of the appliance, the glass panel can be readily removed and replaced.

Although described with reference to preferred embodiments of the invention, it should be readily understood that various changes and/or modifications can be made to the invention without departing from the spirit thereof. In general, the invention is only intended to be limited by the scope of the following claims.

We claim:

1. A kitchen appliance comprising:

a support body;

a compartment supported by the support body, said compartment having a frontal opening;

a door supported by the support body and shiftable relative to the compartment so as to selectively close the frontal opening, said door including a main body panel having a top edge section, a bottom edge section and opposing side edge sections that define an inner panel portion and an outer panel portion;

a plurality of mounting members spaced about the outer panel portion of the door inward from the top, bottom and opposing side edge sections; and a glass panel assembly including a glass panel and a plurality of mounting elements, said plurality of mounting elements being adhesively secured to the glass panel and inter-engaging with the plurality of mounting members such that the glass panel is mounted to the door with the glass panel being spaced from, yet substantially, completely covering, the outer panel portion wherein, when the kitchen appliance is normally viewed, neither the plurality of mounting elements nor the plurality of mounting members is exposed such that the glass panel appears to float relative to the door.

2. The kitchen appliance according to claim 1, wherein the plurality of mounting elements interengage with the plurality of mounting members through vertical shifting of the glass panel relative to the door.

3. The kitchen appliance according to claim 1, wherein the door is provided with a base member, said base member securing a bottom edge section of the glass panel to the door.

4. The kitchen appliance according to claim 1, wherein the glass panel includes a plurality of edge which are exposed to view.

5. The kitchen appliance according to claim 4, wherein the glass panel includes a plurality of edge portions, said plurality of mounting elements being mounted to the glass panel spaced inward from the plurality of edge sections.

6. The kitchen appliance according to claim 1, wherein each of the plurality of mounting members is constituted by a keyhole-shaped opening formed in the outer panel portion.

7. The kitchen appliance according to claim 5, wherein each of the plurality of mounting elements includes a main body having a base section and an outer section, said outer section being provided with a tab member that establishes an L-shaped hook.

8. The kitchen appliance according to claim 7, wherein the door is provided with a base member, said base member being constituted by a bracket mounted adjacent a lower edge section of the outer panel portion.

9. The kitchen appliance according to claim 8, further comprising:

an upper trim piece; and a plurality of crown elements mounted at an upper edge portion of the glass panel, said upper trim piece being secured to the glass panel via mechanical fasteners that extend through the plurality of crown elements.

10. The kitchen appliance according to claim 5, wherein the glass panel is bowed.

11. The kitchen appliance according to claim 5, wherein the glass panel includes an upper edge portion and at least two laterally spaced openings arranged adjacent the upper edge portion.

12. The kitchen appliance according to claim 11, wherein the door is provided with a handle, said handle being adapted to be secured to the glass panel.

13. The kitchen appliance according to claim 12, wherein the outer panel portion is provided with at least two laterally spaced mechanical fasteners positioned adjacent the upper edge section, said at least two laterally spaced mechanical fasteners being adapted to secure an upper trim piece to the door.

14. The kitchen appliance according to claim 5, wherein the plurality of mounting members are integrally formed in the outer panel portion.

15. The kitchen appliance according to claim 1, wherein the kitchen appliance constitutes a dishwasher.

16. A method of mounting a glass panel to a door of a kitchen appliance, the door including a main body panel having a top edge section, a bottom edge section and opposing side edge sections that define an inner panel portion and an outer panel portion, the method comprising:

providing a plurality of mounting members on the outer panel portion of the door, with said plurality of mounting members being spaced inward from the edge sections of the main body panel;

attaching a plurality of mounting elements to an inner panel portion of a glass panel, with said plurality of mounting elements being spaced inward from an outer edge portion of the glass panel; and slidingly inter-engaging the mounting elements with the mounting members to secure the glass panel to the door, said glass panel being spaced from, yet substantially completely covering, the outer panel portion of the door with neither the mounting members nor the mounting elements being readily visible when the kitchen appliance is viewed from front or angled side views thereby providing an illusion that the glass panel appears to float relative to the door.

17. The method of claim 16, wherein the mounting elements are adhesively secured to the glass panel.

18. The method of claim 16, further comprising: securing the glass panel to the door with a plurality of mechanical fasteners.

* * * * *